US010514138B2

(12) United States Patent
Dhali et al.

(10) Patent No.: US 10,514,138 B2
(45) Date of Patent: Dec. 24, 2019

(54) LIGHTING PLACEMENTS SYSTEM

(71) Applicant: American Woodmark Corporation, Winchester, VA (US)

(72) Inventors: Sahil Dhali, Winchester, VA (US); Kannan Sundaram, Winchester, VA (US)

(73) Assignee: American Woodmark Corporation, Winchester, VA (US)

( * ) Notice: Subject to any disclaimer, the term of this patent is extended or adjusted under 35 U.S.C. 154(b) by 57 days.

(21) Appl. No.: 15/782,479

(22) Filed: Oct. 12, 2017

(65) Prior Publication Data

US 2018/0106439 A1 Apr. 19, 2018

Related U.S. Application Data

(60) Provisional application No. 62/407,637, filed on Oct. 13, 2016.

(51) Int. Cl.

| | |
|---|---|
| ***F21S 4/28*** | (2016.01) |
| ***F21V 33/00*** | (2006.01) |
| ***F21V 21/088*** | (2006.01) |
| ***A47F 11/10*** | (2006.01) |
| *F21W 131/301* | (2006.01) |

(52) U.S. Cl.

CPC ..... *F21S 4/28* (2016.01); *A47F 11/10* (2013.01); *F21V 21/088* (2013.01); *F21V 33/0012* (2013.01); *A47B 2220/0077* (2013.01); *F21W 2131/301* (2013.01)

(58) Field of Classification Search

CPC ..... F21V 21/088; A47B 2220/0077; F21W 2131/301

See application file for complete search history.

(56) References Cited

U.S. PATENT DOCUMENTS

| | | | | |
|---|---|---|---|---|
| 7,329,024 | B2 * | 2/2008 | Lynch | F21V 3/04 257/99 |
| 7,815,341 | B2 * | 10/2010 | Steedly | F21V 19/0055 362/217.01 |
| 2009/0161371 | A1 * | 6/2009 | Vukosic | B60Q 1/2611 362/373 |
| 2011/0058357 | A1 * | 3/2011 | Anderson | A47F 3/001 362/125 |
| 2011/0286207 | A1 * | 11/2011 | Chan | F21V 15/013 362/217.1 |

* cited by examiner

*Primary Examiner* — Evan P Dzierzynski
(74) *Attorney, Agent, or Firm* — McGuireWoods LLP

(57) ABSTRACT

A light placement system includes a mounting strip including an illuminating device. The light placement system also includes a clip that is attached to a surface of an object and holds the mounting strip to illuminate an area of the object. The surface is an internal surface that is not visible from an external appearance of the object.

28 Claims, 9 Drawing Sheets

LIGHTING PLACEMENTS SYSTEM

CROSS REFERENCE TO PRIOR APPLICATION

This application claims priority to and benefit from U.S. Provisional Patent Application No. 62/407,637 filed on Oct. 13, 2016, titled "LIGHTING PLACEMENTS SYSTEM AND METHOD," the entirety of which is hereby incorporated by reference herein.

FIELD OF THE DISCLOSURE

The present disclosure relates generally to lighting systems and, more specifically, to lighting systems for cabinetry.

BACKGROUND OF THE DISCLOSURE

Lighting in cabinets has become ubiquitous. Cabinet lighting exists in many forms, including under cabinet lighting, in-cabinet lighting, and above cabinet lighting. Under cabinet lighting is frequently installed in kitchens to provide lighting for countertops to improve visibility for food preparation or cooking. In-cabinet lighting is frequently installed in highlight objects placed in cabinets. Above cabinet lighting is frequently installed in enhance aesthetics in kitchens.

When cabinets are manufactured, light fixtures are typically not installed therein. Instead, lighting fixtures are generally installed during (or after) installation of cabinets at the installation site. Such installations can add substantial cost and delay to cabinet installation. Also, unsightly wiring may result where multiple lighting fixtures are installed.

Accordingly, there exists an unfulfilled need for a lighting solution to cabinets and cabinetry.

SUMMARY OF THE DISCLOSURE

One aspect of the present disclosure provides a light placement system, which includes a mounting strip including an illuminating device; and a clip that is attached to a surface of an object and holds the mounting strip to illuminate an area of the object. The surface is an internal surface that is not visible from external appearance of the object.

The object may be a cabinet. The mounting strip may include a first wing portion having a first surface; and a second wing portion having a second surface that is substantially perpendicular to the first surface, wherein the first and second surfaces are in contact with the clip. The mounting strip may further include a third surface extending between the first and second contact surfaces. The third surface may be recessed from the first and second surfaces.

The mounting strip may further include a fourth surface tilted at a predetermined angle with respect to the first contact surface; a pair of sidewalls extending from the fourth surface; and a holding space defined by the fourth surface and the pair of sidewalls, wherein the illuminating device is placed in the holding space. The fourth surface may be tilted at an angle of between about 30° degrees and about 60° degrees with respect to the first surface. The first and second wing portions may be tapered to have a narrower tip end.

The clip may include a contact wall including a first surface in contact with the surface of the object; a strip holder that receives and holds the mounting strip; and a spacer extending between the contact wall and the strip holder to position the mounting strip at a predetermined distance from the surface of the object.

The strip holder may include an inner surface that is in at least partial contact with the mounting strip. The inner surface may include a second surface that is substantially perpendicular to the first surface of the contact wall; a third surface that is substantially parallel to the first surface of the contact wall; and; and a fourth surface extending between the second and third surface and shaped to fit a profile of the mounting strip. The fourth surface may protrude out from the second and third surfaces.

The strip holder may further include a first hook extending from a first side of the inner surface; and a second hook extending from a second side of the inner surface, wherein the first and second hooks may be flexible. The strip holder may further include a first slot formed between the first hook and the first side of the inner surface; and a second slot formed between the second hook and the second side of the inner surface, wherein the first and second slots may be tapered to have a narrower bottom end.

The surface of the object may include a first and second surface adjoining each other, wherein the clip may include a first wing portion including a first inner surface in contact with the mounting strip and a first outer surface in contact with the first surface of the object; a second wing portion including a second inner surface in contact with the mounting strip and a second outer surface in contact with second surface of the object; and a middle portion extending between the first and second wing portions and having a third inner surface shaped to fit a profile of the mounting strip. The first and second wing portions may include at least one hole extending therethrough.

The clip may further include a first hook extending from a side of the first wing portion; a first slot formed between the first hook and the first inner surface of the first wing portion; a second hook extending from a side of the second portion; and a second slot formed between the second hook and the second inner surface of the second wing portion. The first and second slots may be tapered to have a narrower bottom end. The second inner surface may be substantially perpendicular to the first inner surface.

According to another aspect of the disclosure, a mounting strip includes a first wing portion having a first surface; a second wing portion having a second surface that is substantially perpendicular the first surface; a third surface that is recessed and extending between the first and second surfaces; a fourth surface formed on an opposite side of the third surface and tilted at a predetermined angle with respect to the first surface; and a pair of sidewalls extending from the fourth surface.

According to yet another aspect of the disclosure, a clip includes a first wing portion having a first surface; a second wing portion having a second surface that is substantially perpendicular to the first surface; a middle portion formed between the first and second wing portions and having a protruding surface between the first and second surfaces; a first hook extending from a side of the first wing portion; a first slot formed between the first hook and the first surface; a second hook extending from a side of the second wing portion; and a second slot formed between the second hook and the second surface of the second wing portion.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the disclosure in more detail than may be necessary for a fundamental understanding of the disclosure and the various ways in which it may be practiced.

DETAILED DESCRIPTION OF THE DISCLOSURE

Figure 1:
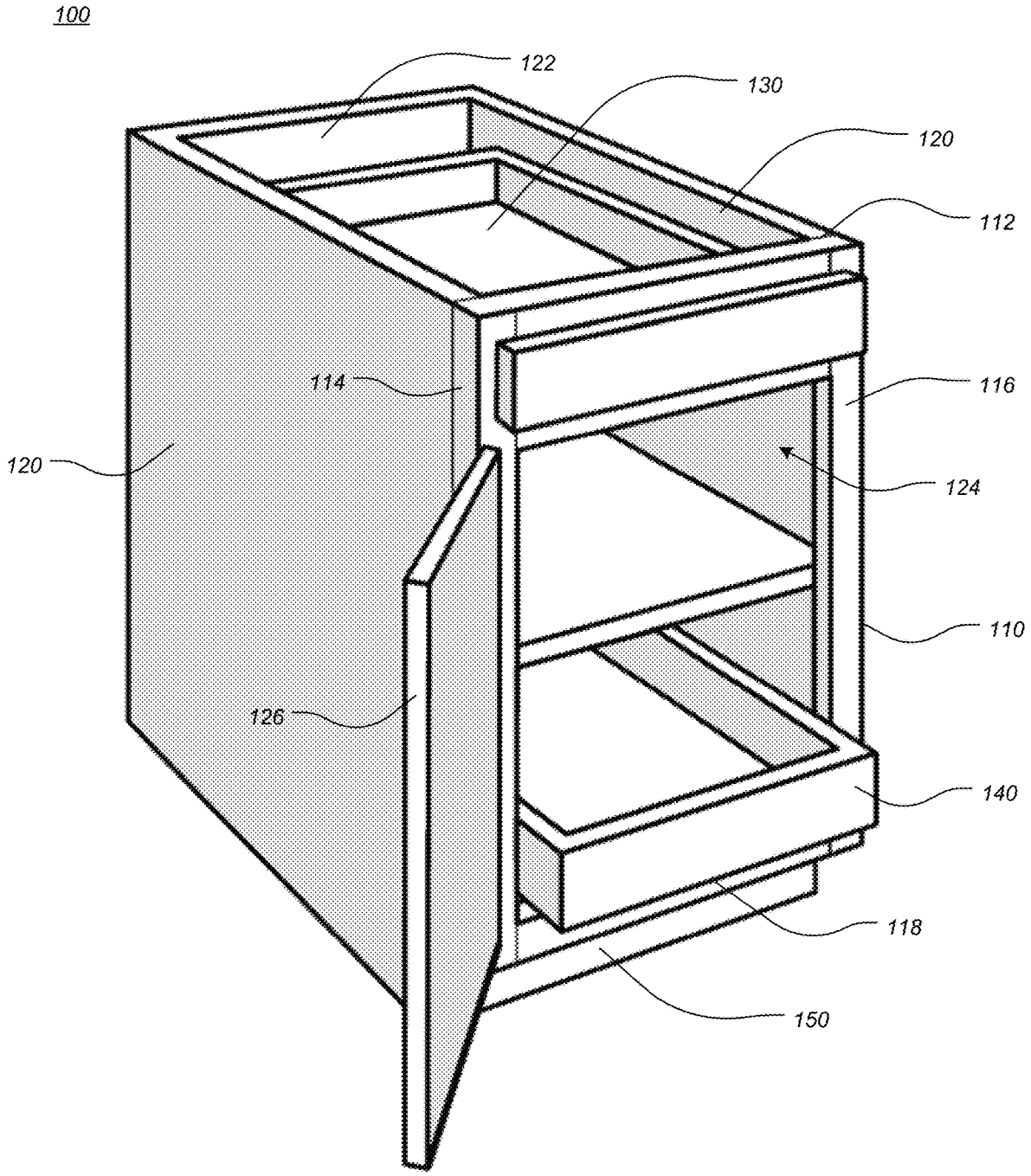
FIG. 1 shows a perspective view of a cabinet.

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

Figure 2:
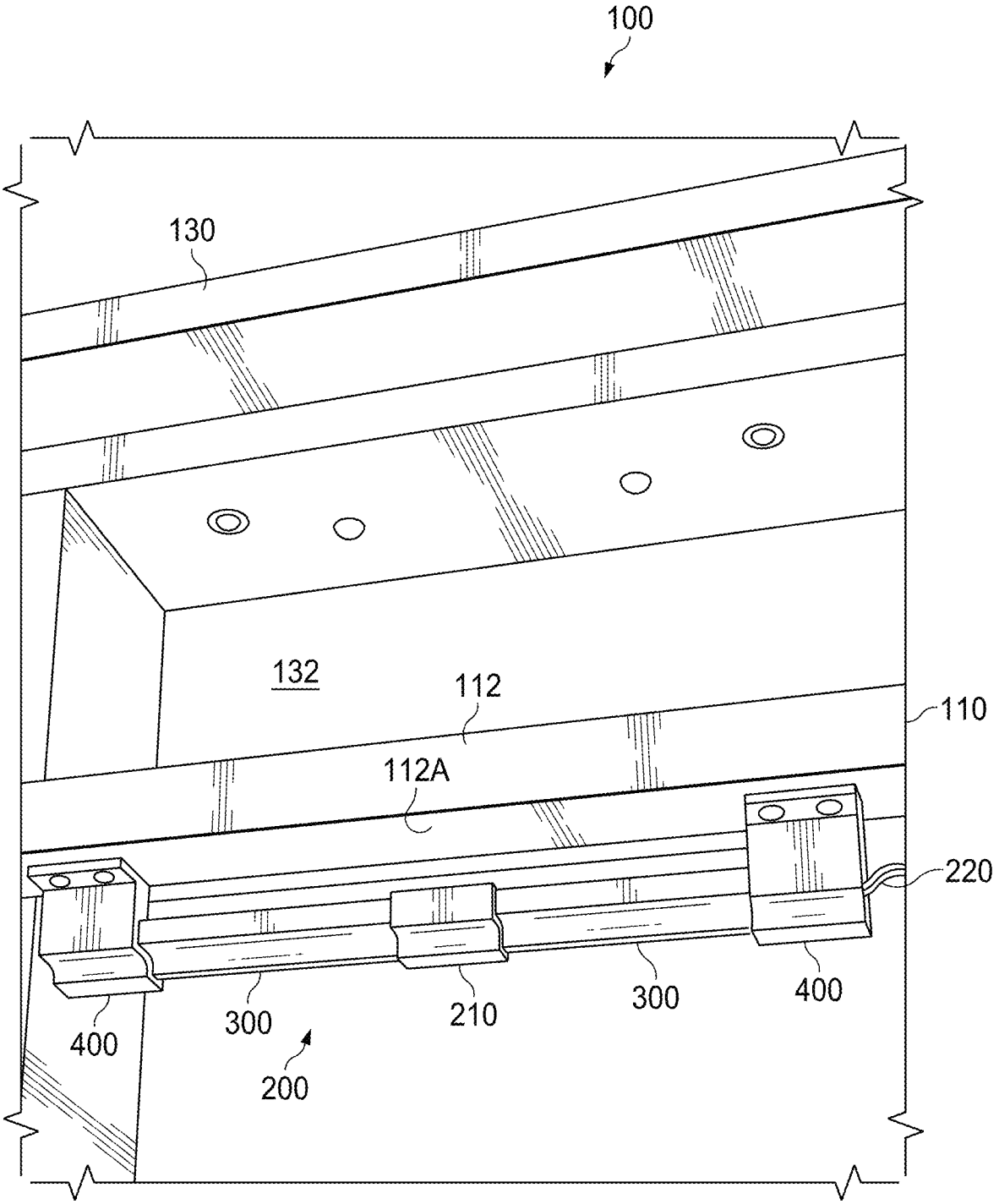
FIGS. 2 and 3 show an example of a lighting placement system constructed according to the principles of the disclosure, which is installed in the cabinet of FIG. 1.
Figure 3:
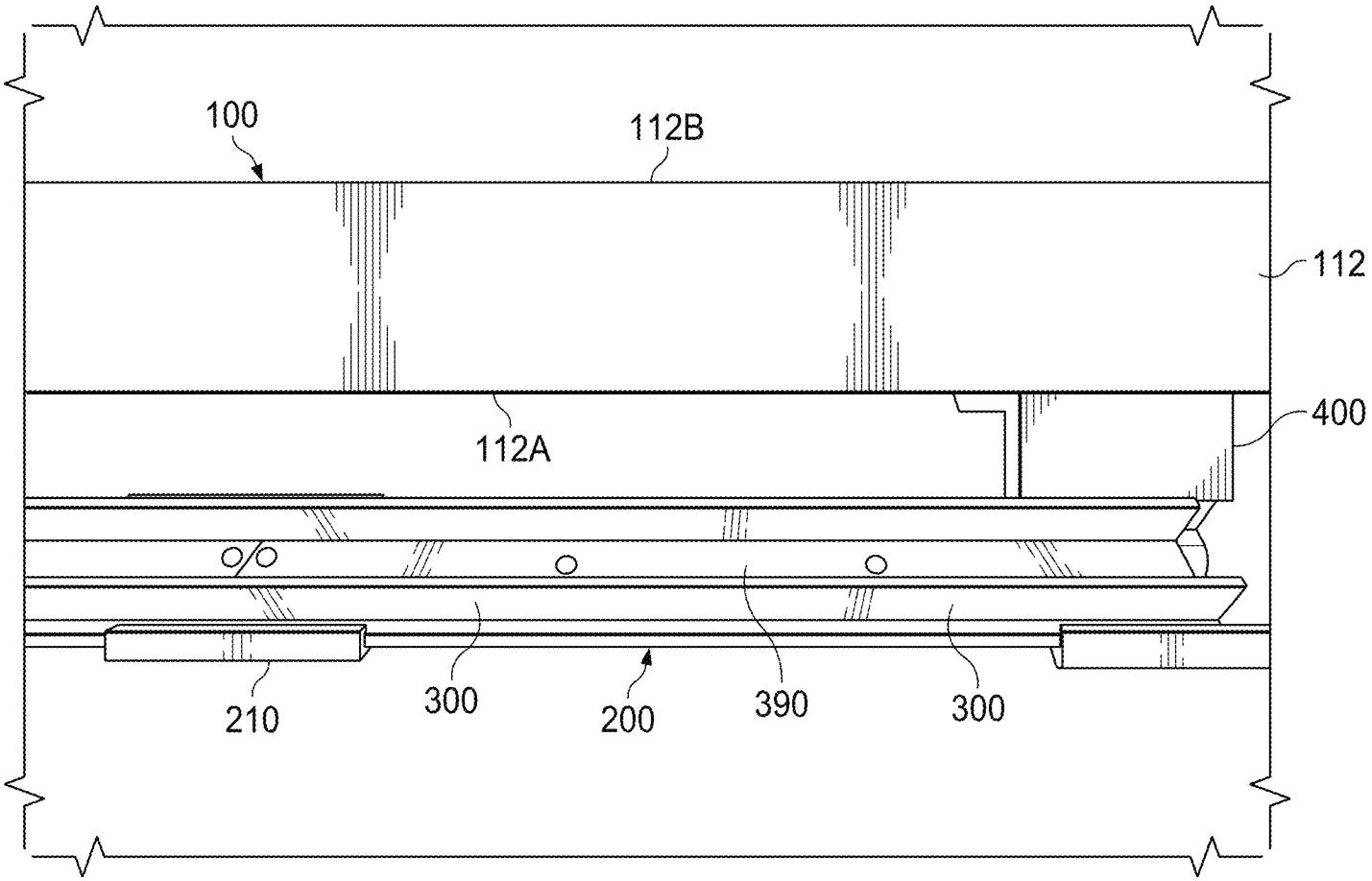

FIG. 1 shows a cabinet 100, and FIGS. 2 and 3 show an example of a lighting placement system 200 constructed according to the principles of the disclosure, installed in the cabinet 100. The lighting placement system 200 may be installed in or on virtually any stationary or movable object intended to store items (e.g., cabinets, shelves or racks), or support various human activities, such as seating (e.g., chairs, stools or sofas), eating (e.g., tables), sleeping (e.g., beds), working (e.g., desks, benches or kitchens. In FIGS. 1, 2 and 3, the cabinet 100 is a base cabinet, but the lighting placement system 200 may be installed in different cabinet types, such as, for example, wall cabinets, tall cabinets, vanity cabinets, and other miscellaneous cabinets. The lighting placement system 200 may either be pre-installed when a cabinet is being manufactured, installed in a cabinet when the cabinet is installed, or added to retrofit an existing cabinet.

Referring to FIG. 1, the cabinet 100 includes a front frame 110, left and right sidewalk 120, a rear wall 122, a main storage space 124, a door 126, a top drawer 130, a bottom drawer 140, and a toe kick 150. The front frame 110 includes a top frame 112, left and right side frames 114, 116, and a bottom frame 118. The lighting placement system 200 may be attached to any surfaces of the cabinet 100 to illuminate one or more interior and/or exterior areas of the cabinet 100, including, for example, the main storage space 124, the top drawer 130, the bottom drawer 140, the toe kick 150, and/or the like.

The lighting placement system 200 may be placed to be hidden from an external appearance of the cabinet 100. The lighting placement system 200 may be attached to one or more internal surfaces that are not visible from an external appearance of the cabinet 100. For example, as shown in FIGS. 2 and 3, the lighting placement system 200 may be attached to an inner side surface 112A of the top frame 112 that faces the rear wall 122 such that the lighting placement system 200 is not visible even when the drawer 130 is pulled out. The lighting placement system 200 may include a switch, actuator or sensor (not shown) that detects opening and closing of the top drawer 130 so as to selectively illuminate an interior area 132 when the drawer 130 is pulled out. The light may be turned off when the top drawer 130 is pushed back to its original location.

Referring to FIGS. 2 and 3, the lighting placement system 200 may include, for example, one or more mounting strips 300 and one or more base clips 400 that fix the mounting strip 300 to the cabinet 100. The mounting ship 300 may include one or more illuminating devices 390 (shown in FIG. 3), such as, for example, a light emitting diode (LED), organic LED (OLED), a fluorescent light, or the like. The lighting placement system 200 may be connectable to a power supply system 220, including, for example, a power rail system described in U.S. patent application Ser. No. 15/496,816, filed Apr. 25, 2017, titled "INTEGRATED CABINET LIGHTING," which is incorporated hereto by reference in its entirety. Alternatively or additionally, the lighting placement system 200 may be battery-powered or solar-powered.

As shown in FIGS. 2 and 3, two or more mounting strips 300 may be coupled in series to illuminate a wider area. For example, each mounting strip 300 may include a connector (not shown), such as, for example, a clip, a magnet, thread fitting, or the like, at both ends thereof, to allow two mounting strips 300 to be coupled end-to-end. The connector may include one or more electric terminals and/or connectors (not shown) to send and receive electric power and/or signal to and from another mounting strip 300 or the power supply system 220. The lighting placement system 200 may include a coupling clip 210 to support and protect the end-to-end connection between two mounting strips 300 coupled in series. The coupling clip 230 may be shaped to firmly engage coupling ends of two mounting strips 300 coupled in series together.

The base clip 400 may be configured to hold and fix the mounting strip 300 on a surface of the cabinet 100, for example, on an inner side surface 112A of the top frame 112. Two or more base clips 400 may be used to hold a longer mounting strip 300 or two or more mounting strips 300 coupled in series. For example, as shown in FIG. 2, two base clips 400 may be placed to hold opposing end portions of the two coupled mounting strips 300. A single base clip 400 may be used for a single mounting strip 300. The base clip 400 may be used in replacement of the coupling clip 210.

Figure 4:
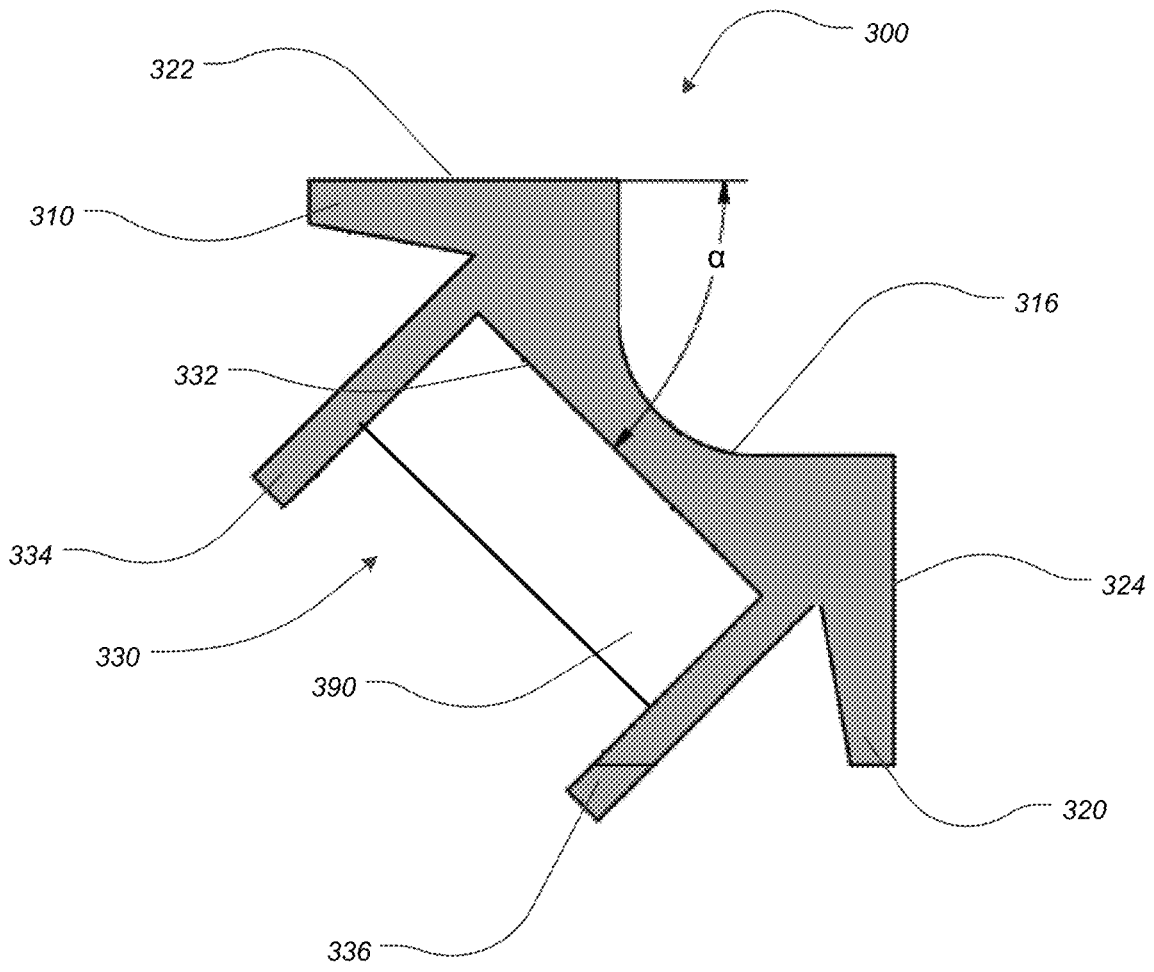
FIG. 4 shows a cross-sectional view of an illumination mounting strip, constructed according to the principles of the disclosure.

FIG. 4 shows a cross-sectional view of an example of the illumination mounting strip 300, constructed according to the principles of the disclosure. The mounting strip 300 may be constructed to engage the coupling clip 210 or the base clip 400 and to receive and hold the illuminating device 390. For example, the mounting strip 300 may have a pair of wing portions 310, 320, which may be shaped to engage corresponding structures of the base clip 400 (shown in FIG. 5). The wing portions 310, 320 may be tapered to have a narrower tip end. The wing portions 310, 320 may have clip contact surfaces 322, 324, respectively, which may be in contact with the base clip 400 when the mounting strip 300 is attached thereto. The clip contact surfaces 322, 324 may be substantially flat and perpendicular to each other. The mounting strip 300 may have a recessed surface 316 between the clip contact surfaces 322, 324, which may be curved in to match a profile of a corresponding structure (e.g., curved surface 436 shown in FIG. 5) of the base clip 400.

The mounting strip 300 may include a holding space 330 to receive and hold the illuminating device 390. The holding space 330 may be defined by a bottom surface 332 and a pair of sidewalls 334, 336 extending from the bottom surface 322. The bottom surface 332 may be formed at an opposite side of the recessed surface 316. The sidewalls 334, 336 may extend substantially perpendicular to the bottom surface 322. The illuminating device 390 may be snapped on to the mounting strip 300 by being pushed into the holding space 320. Alternatively or additionally, a glue or fastener may be used to permanently or removably attach the illuminating device 390 to the mounting strip 300. The sidewalk 334, 336 may protect the illuminating device 390. For example, the sidewalls 334, 336 may be taller than the illuminating device 390 such that an external impact toward the illuminating device 390 may be blocked by the sidewalls 334, 336. The sidewalk 334, 336 may guide and shape the light from the illuminating device 390 to be illuminated in a desired direction and shape.

The bottom surface 332 may be tilted at a predetermined angle $\alpha$ with respect to the clip contract surface 312, to diagonally direct the illuminating devices 390. The mounting strip 300 may be configured such that the bottom surface 332 may be tilted at an angle of between about 30° degrees and about 60° degrees, for example, at an angle of about 45° degrees. The mounting strip 300 may be constructed such that the tilt angle $\alpha$ may be adjustable.

Figure 5:
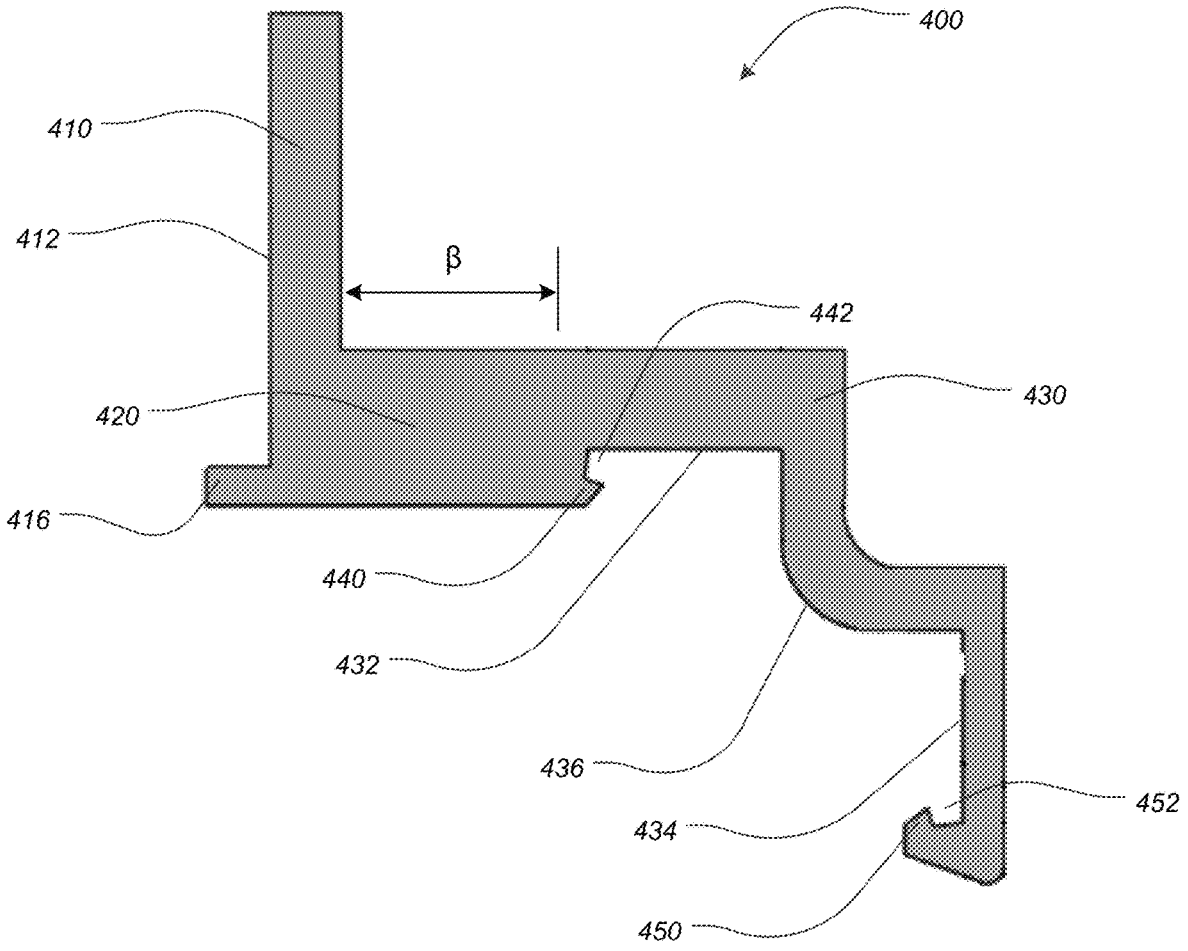
FIG. 5 shows a cross-section view of a base clip, according to the principles of the disclosure.
Figure 6A:
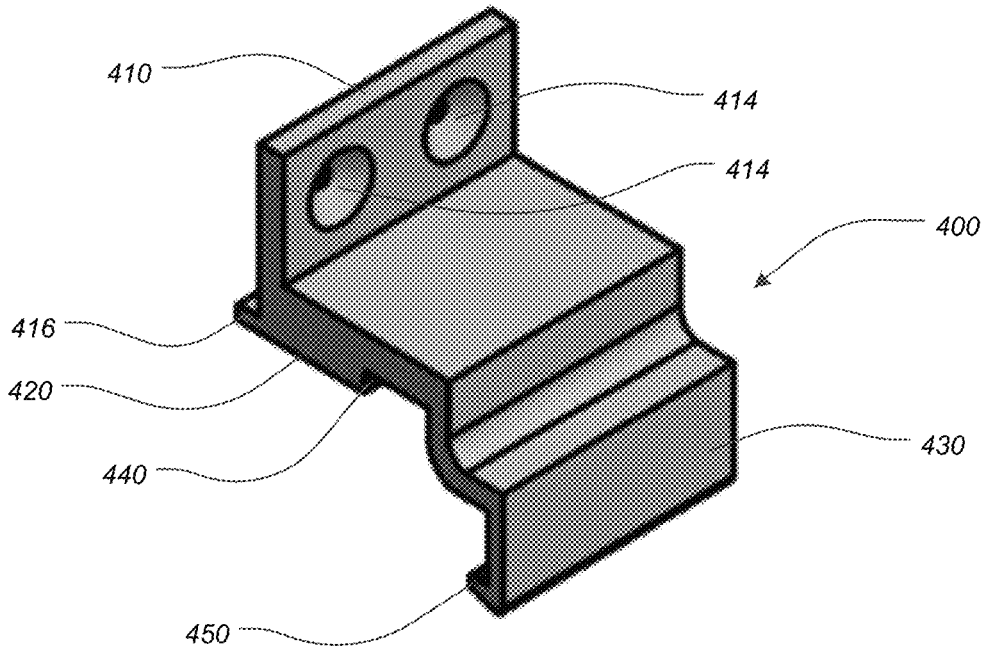
FIGS. 6A and 6B show perspective views of the base clip of FIG. 5.
Figure 6B:
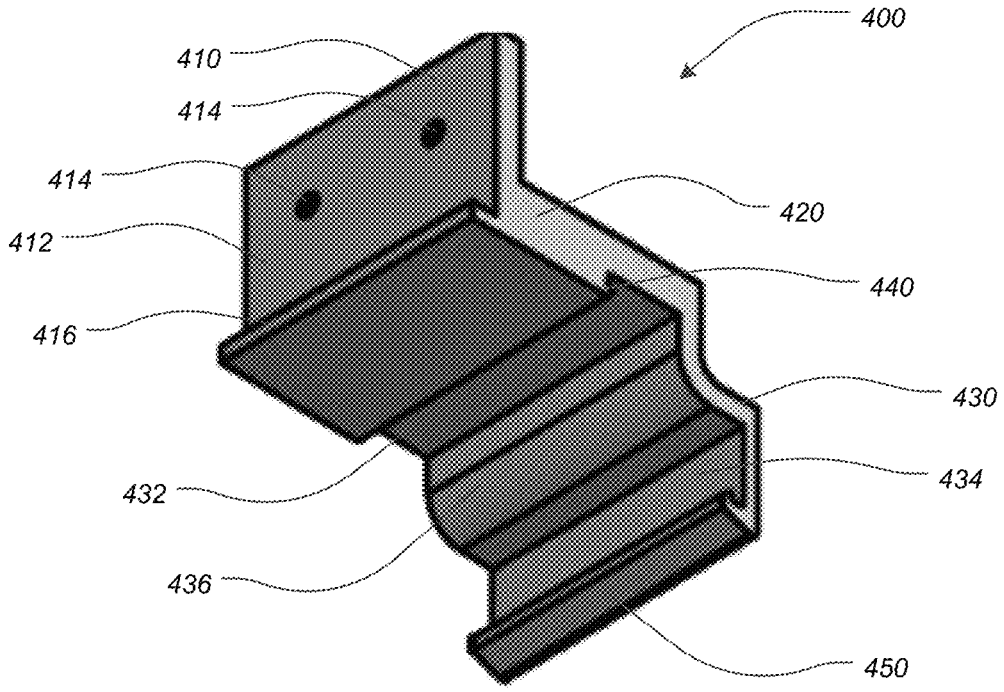

FIG. 5 shows a cross-sectional view of an example of the base clip 400, constructed according to the principles of the disclosure. FIGS. 6A and 6B show perspective views of the base clip 400. The base clip 400 may be configured to hold and fix the mounting strip 300 on a surface of an object, for example, the inner side surface 112A of the top frame 112 of the cabinet 100, as shown in FIGS. 2 and 3.

Referring to FIGS. 5, 6A and 6B concurrently, the base clip 400 may include a surface contact wall 410, a spacer portion 420, and a strip holder 430. The surface contact wall 410 may have a substantially flat contract surface 412 to be in contact with the inner side surface 112A of the cabinet. The surface contact wall 410 may have one or more holes 414 (shown in FIGS. 6A, 6B) such that the base clip 400 may be affixed to the surface 112A by, for example, screws, nails or the like. Alternatively, the surface contact wall 410 may be glued to the surface 112A, or other permanent or removable fasteners may be used to affix the base clip 400 to the surface 112A. The surface contact wall 410 may have a tab 416, which may protrude substantially perpendicular to the contact surface 412. The tab 416 may protrude from a bottom portion of the surface contact wall 410 to be in contact with a bottom surface 112B (shown in FIG. 3) of the top frame 112. The tab 416 may be used to align the base clip 400 on the inner side surface 112A when the base clip 400 is attached to the top frame 112. The tab 416 may also prevent the base clip 400 from moving on the surface 112A when an external force is applied to the base clip 400.

The spacer portion 420 may be configured to bridge the surface contact wall 410 and the strip holder 430. The spacer portion 420 may be constructed to position the mounting strip 300 held by the strip holder 430 at a predetermined distance from the surface 112A of the cabinet 100. For example, the spacer portion 420 may extend laterally from the bottom portion of the surface contact wall 410 in a direction opposite to the tab 416. The spacer portion 420 may extend substantially perpendicular to the contact surface 412.

A lateral width $\beta$ of the spacer portion 420 may be predetermined such that the mounting strip 300 is not visible to a user when the top drawer 130 is pulled out. The base clip 400 may be constructed such that the lateral width $\beta$ may be adjusted. For example, spacer portions 420 having different lateral widths $\beta$ may be manufactured such that a spacer portion 420 having a desired lateral width $\beta$ may be permanently or removably conjoined together with the surface contact wall 410 and the strip holder 430.

The strip holder 430 is configured to receive and hold the mounting strips 300. The strip holder 430 may extend from the spacer portion 420. The strip holder 430 may be constructed to receive and hold the mounting strips 300. For example, the strip holder 430 may have a plurality of inner contact surfaces 432, 434, 436 that are shaped and sized to be in at least partial contact with the contact surfaces 322, 324, 326 of the mounting strip 300, respectively. The contact surfaces 432, 434 may be substantially flat. The contact surface 436 may extend between the contact surfaces 432, 434 and protrude diagonally in a shape conformal to the recessed surface 316 of the mounting strip 300. Alternatively, the recessed surface 316 and/or the contact surface 436 may be shaped to form a gap therebetween (not shown).

The contact surface 432 may be substantially perpendicular to the contact surface 412 of the surface contact wall 410, and the contact surface 434 may be substantially perpendicular be contact surface 432. Hence, once the base clip 400 is attached to the inner side wall 112A of the cabinet 100, the contact surface 434 may be substantially parallel to the inner side wall 112A; and the illuminating devices 390 held by the base clip 400 may be tilted at a predetermined angle, for example, at about 45° degrees. Alternatively, the strip holder 430 may be pivotally connected to the spacer portion 420 (not shown) to allow the user to manually adjust a tilt angle of the illuminating devices 390.

The strip holder 430 may include a pair of hooks 440, 450, which may extend from sides of the contact surfaces 432, 434, respectively. A pair of slots 442, 452 may be formed between the contact surface 432 and the hook 440 and between the contact surface 434 and the hook 450, respectively. The slots 442 may be configured to receive and firmly grab the tip ends of the wing portions 310, 320, respectively. The slots 442 may be tapered to have a wider opening and a narrower bottom end to match the tapered tip ends of the wing portions 310, 320. The hooks 440, 450 may flex to allow the tip ends of the wiring portions 310, 320 to be inserted into the slots 442, 452, respectively. Once the mounting strip 300 is inserted, the hooks 440, 450 may push the mounting strip 300 towards the contact surfaces 436, 442, 452 such that the mounting strip 300 is affixed to the strip holder 430. No glue or fastener may be necessary to affix the mounting strip 300 to the strip holder 430. Alternatively or additionally, a glue or fastener may be used to permanently or removably affix the mounting strip 300 to the strip holder 430.

Figure 7:
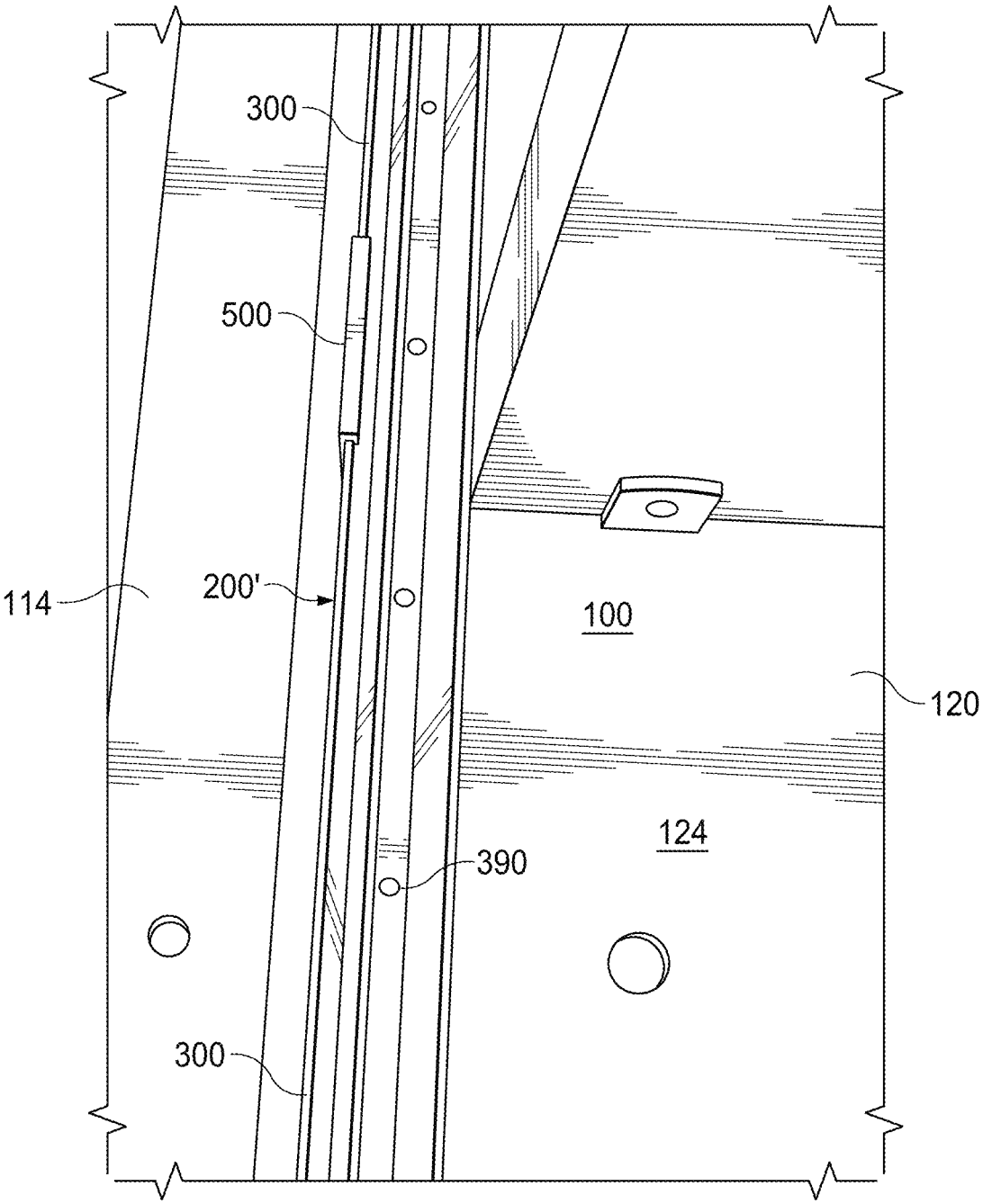
FIG. 7 shows another example of a lighting placement system, constructed according to the principles of the disclosure, which is installed in the cabinet of FIG. 1.

FIG. 7 shows another example of a lighting placement system 200', constructed according to the principles of the disclosure, which is attached to the left frame 114 and/or the sidewall 120 of the cabinet and to illuminate the main storage space 124 of the cabinet 100. The system 200' may be attached to the right frame 124 but the system 200' attached to the left frame 114 may be less visible and obstructive since, as seen in FIG. 1, the door 126 is attached to the left side frame 114.

Referring to FIG. 7, the lighting placement system 200' may include one or more mounting strips 300 and one or more wall clips 500 that are combined together. The mounting strips 300 may be coupled in series to extend vertically along the left frame 114. The construction, interconnection and powering of the mounting strips 300 are described above. The wall clips 500 may be constructed to attach a single mounting strip 300 or two or more mounting strips 300 coupled in series to a corner of the cabinet 100 between the left frame 114 and/or the sidewall 120 of the cabinet 100. Similar to the coupling clip 210 shown in FIGS. 2 and 3, the wall clip 500 may be positioned to support and protect the end-to-end connection between two strips 300 coupled in series. The wall clip 500 may be constructed similar to the coupling clip 210 except that the coupling clip 210 may not be constructed to be readily attachable to a surface. The wall clip 500 may be used as the coupling clip 210.

Figure 8:
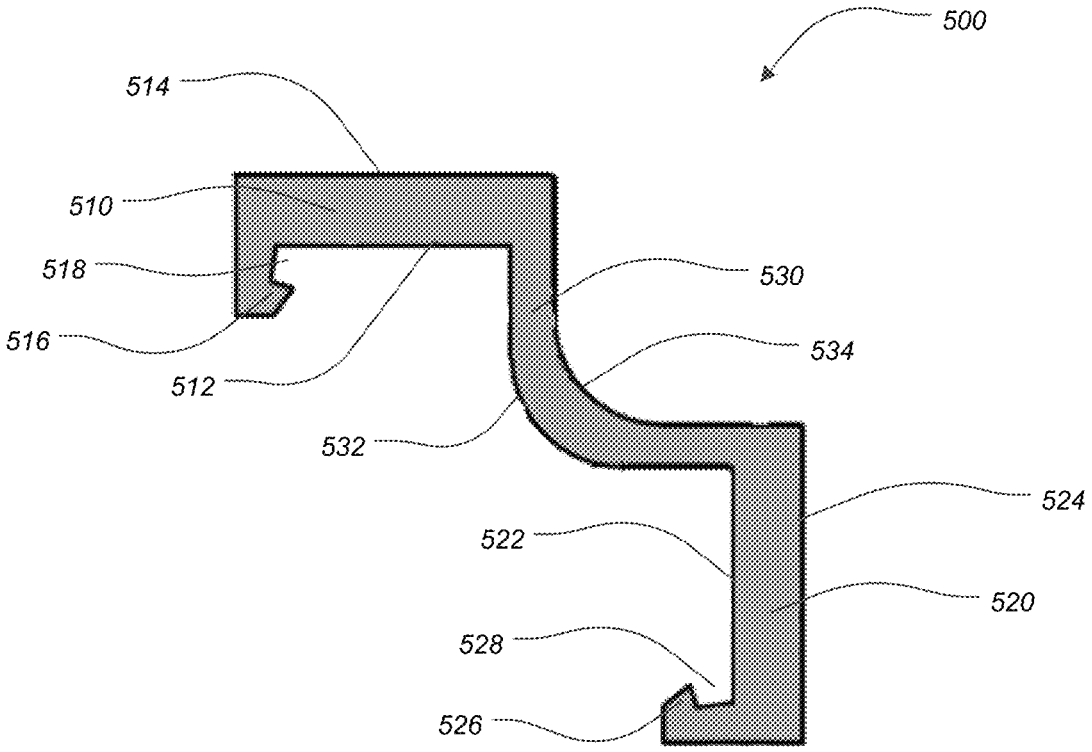
FIG. 8 shows a wall clip, constructed according to the principles of the disclosure.
Figure 9A:
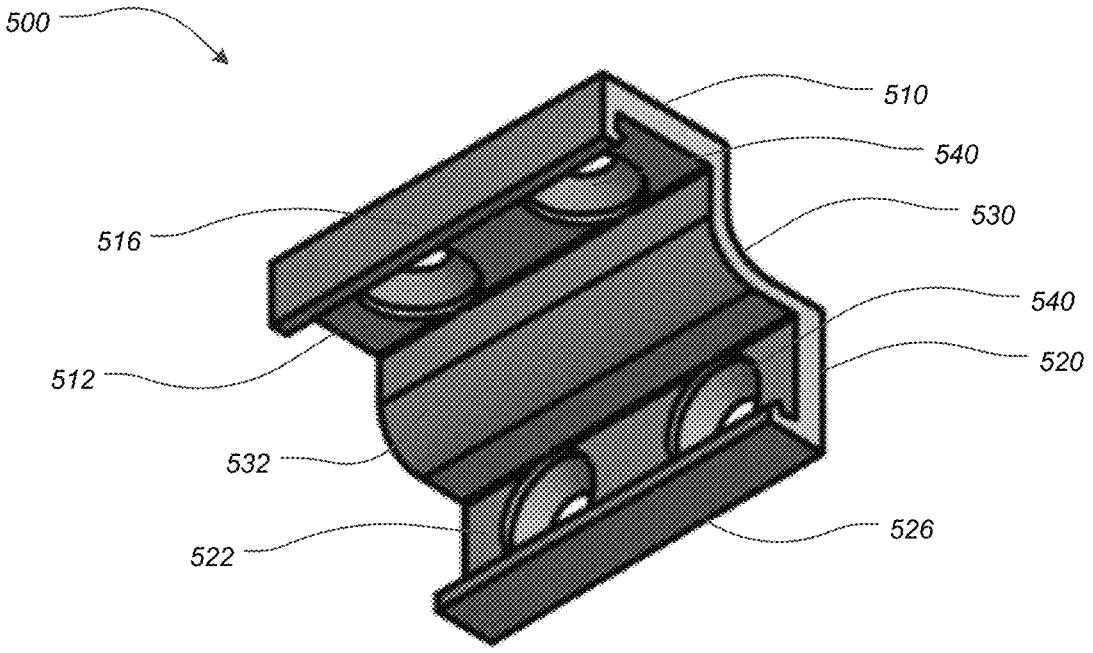
FIGS. 9A and 9B show perspective views of the wall clip of FIG. 8.
Figure 9B:
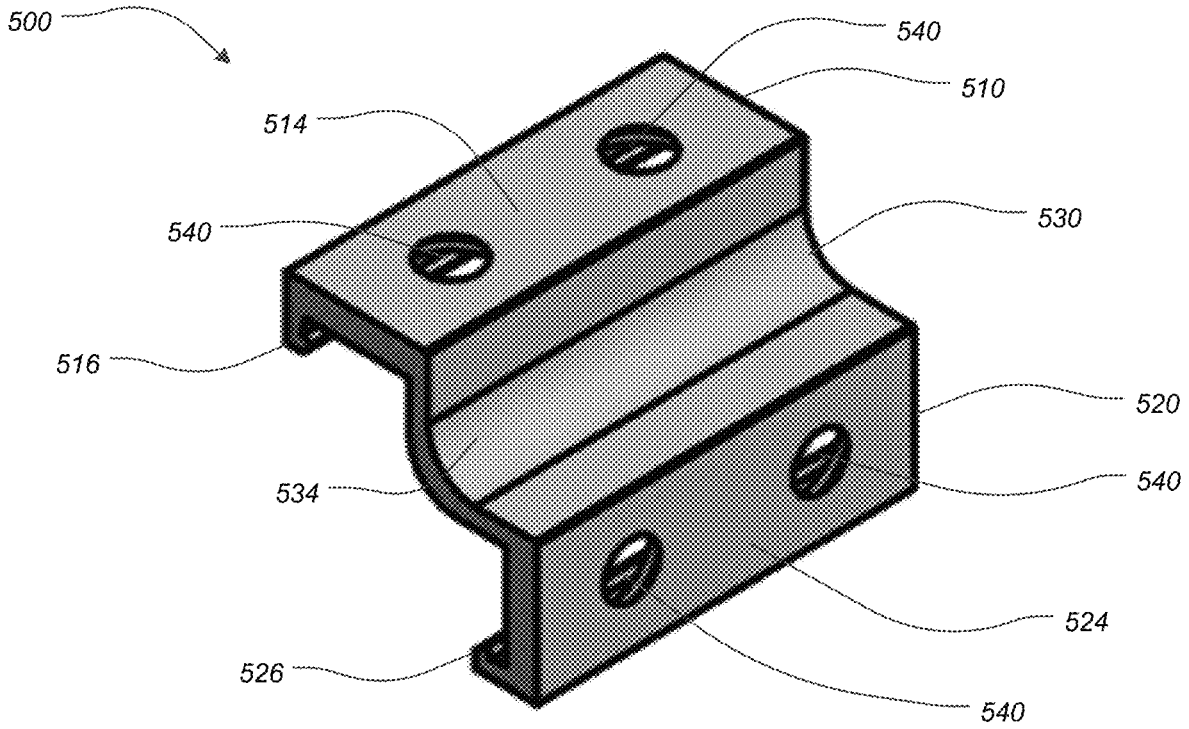

FIG. 8 shows an example of the wall clip 500, constructed according to the principles of the disclosure. FIGS. 9A and 9B show perspective views of the wall clip 500. The wall clip 500 may be constructed similar to the strip holder 430 of the base clip 400, shown in FIGS. 5, 6A and 6B. The wall clip may include first and second wing portions 510, 520 and a middle portion 530 extending between the wing portions 510, 520. The first and second wing portions 510, 520 may include one or more holes 540 (shown in FIGS. 9A and 9B) such that the wall clip 500 may be affixed by, for example, screws, nails or the like, to at least one of the left frame 114 and the left side wall 120.

The first wing portion 510 may include, for example, an inner surface 512, an outer surface 514, a hook 516, a slot 518, and/or the like. The inner and outer surfaces 512 and 514 may be substantially flat and parallel to each other. The inner surface 512 may be configured to be in at least partial contact with the contact surface 322 of the mounting strip 300 (shown in FIG. 4). The outer surface 514 may be configured to be in contact with a surface of the left frame 114. The hook 516 may positioned at a tip end of the first wing portion 510, and the slot 518 may be formed between the hook 516 and the inner surface 512.

The second wing portion 520 may extend substantially perpendicular to the first wing portion 510. The second wing portion 520 may be constructed similar to the first wing portion 510. The second wing portion 520 may include, for example, an inner surface 522, an outer surface 524, a hook 526, a slot 528, and/or the like. The inner and outer surfaces 522 and 524 may be substantially flat and parallel to each other. The inner surface 522 may be configured to be in contact with the contact surface 324 of the mounting strip 300 (shown in FIG. 4). The outer surface 514 may be configured to be in contact with a surface of the left sidewall 120. The hook 526 may positioned at a tip end of the second wing portion 520, and the slot 528 may be formed between the hook 526 and the inner surface 522.

The middle portion 530 may extend curved between the first and second wing portions 510, 520. The middle portion 530 may include an inner surface 532 and an outer surface 530. The inner surface 532 may extend between the inner surfaces 512, 522 of the first and second wing portions 510, 520. The inner surface 532 may be curved out to fit a profile of the recessed surface 316 (shown in FIG. 4) of the mounting strips 300. The outer surface 534 may be curved in to be parallel to the inner surface 532.

Similar to the slots 442, 452 of the base clip 400 (shown in FIG. 5), the slots 518, 528 may be tapered to match the profile of the tip ends of the wings 310, 320 of the mounting strips 300. The hooks 516, 526 may flex to allow the mounting strip 300 to be pushed and rested on the inner surfaces 512, 522, 532. Once the mounting strip 300 is inserted into and held by the wall clip 500, the hooks 516, 526 may apply a force to the mounting strip 300 to stay affixed to the wall clip 500. Alternatively or additionally, a glue or fastener may be used to permanently or removably affix the mounting strip 300 to the wall clip 500.

The first and second wing portions 510, 520 may extend substantially perpendicular to each other. The inner surfaces 512, 522 may be substantially perpendicular to each other. The outer surfaces 514, 524 may be substantially perpendicular to each other. As seen on FIG. 4, the bottom surface 322 of the mounting strip 300 may be tilted at a predetermined angle $\alpha$, for example, about 45° degrees, with respect to the clip contract surface 312, to diagonally direct the illuminating devices 390. Hence, when the mounting strip 300 is affixed to the wall clip 500, the illuminating devices 390 may be tilted diagonally at a predetermined angle, for example, about 45° degrees.

The terms "including," "comprising" and variations thereof, as used in this disclosure, mean "including, but not limited to," unless expressly specified otherwise.

The terms "a," "an," and "the," as used in this disclosure, mean "one or more," unless expressly specified otherwise.

Devices that are in communication with each other need not be in continuous communication with each other, unless expressly specified otherwise. In addition, devices that are in direct contact with each other may contact each other directly or indirectly through one or more intermediary articles or devices.

Although process steps, method steps, or the like, may be described in a sequential order, such processes and methods may be configured in alternate orders. In other words, any sequence or order of steps that may be described does not necessarily indicate a requirement that the steps be performed in that order. The steps of the processes or methods described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device or article may be alternatively embodied by one or more other devices or articles which are not explicitly described as having such functionality or features.

While the disclosure has been described in terms of exemplary embodiments, those skilled in the art will recognize that the disclosure can be practiced with modifications in the spirit and scope of the appended claim, drawings and attachment. The examples provided herein are merely illustrative and are not meant to be an exhaustive list of all possible designs, embodiments, applications or modifications of the disclosure.

What is claimed is:

1. A light placement system, comprising:

a mounting strip comprising an illuminating device; and a clip that is attached to a surface of an object and holds the mounting strip to illuminate an area of the object;

wherein the surface is an internal surface that is not visible from an external appearance of the object;

wherein the mounting strip comprises:

a first wing portion having a first surface; and a second wing portion having a second surface that is substantially perpendicular to the first surface;

wherein the first and second surfaces are in contact with the clip.

2. The light placement system of claim 1, wherein the object is a cabinet.

3. The light placement system of claim 1, wherein the mounting strip further comprises a third surface extending between the first and second contact surfaces.

4. The light placement system of claim 3, wherein the third surface is recessed from the first and second surfaces.

5. The light placement system of claim 3, wherein the mounting strip further comprises:

a fourth surface tilted at a predetermined angle with respect to the first contact surface;

a pair of sidewalls extending from the fourth surface; and a holding space defined by the fourth surface and the pair of sidewalls, wherein the illuminating device is placed in the holding space.

6. The light placement system of claim 5, wherein the fourth surface is tilted at an angle of between about 30° degrees and about 60° degrees with respect to the first surface.

7. The light placement system of claim 1, wherein the first and second wing portions are tapered to have a narrower tip end.

8. The light placement system of claim 1, wherein the clip comprises:

a contact wall comprising a first surface in contact with the surface of the object;

a strip holder that receives and holds the mounting strip; and a spacer extending between the contact wall and the strip holder to position the mounting strip at a predetermined distance from the surface of the object.

9. The light placement system of claim 8, wherein the strip holder comprises an inner surface that is at least in partial contact with the mounting strip, the inner surface comprising:

a second surface that is substantially perpendicular to the first surface of the contact wall;

a third surface that is substantially parallel to the first surface of the contact wall; and a fourth surface extending between the second and third surface and shaped to fit a profile of the mounting strip.

10. The light placement system of claim 9, wherein the fourth surface protrudes out from the second and third surfaces.

11. The light placement system of claim 9, wherein the strip holder further comprises:

a first hook extending from a first side of the inner surface; and a second hook extending from a second side of the inner surface, wherein the first and second hooks are flexible.

12. The light placement system of claim 11, wherein the strip holder further comprises:

a first slot formed between the first hook and the first side of the inner surface; and a second slot formed between the second hook and the second side of the inner surface, wherein the first and second slots are tapered to have a narrower bottom end.

13. The light placement system of claim 1, wherein the surface of the object comprises a first and second surface adjoining each other, wherein the clip comprises:

a first wing portion comprising a first inner surface in contact with the mounting strip and a first outer surface in contact with the first surface of the object;

a second wing portion comprising a second inner surface in contact with the mounting strip and a second outer surface in contact with second surface of the object; and a middle portion extending between the first and second wing portions and having a third inner surface shaped to fit a profile of the mounting strip.

14. The light placement system of claim 13, wherein the first and second wing portions comprise at least one hole extending therethrough.

15. The light placement system of claim 13, wherein the clip further comprises:

a first hook extending from a side of the first wing portion;

a first slot formed between the first hook and the first inner surface of the first wing portion;

a second hook extending from a side of the second portion; and a second slot formed between the second hook and the second inner surface of the second wing portion.

16. The light placement system of claim 15, wherein the first and second slots are tapered to have a narrower bottom end.

17. The light placement system of claim 13, wherein the second inner surface is substantially perpendicular to the first inner surface.

18. A mounting strip, comprising:

a first wing portion having a first surface;

a second wing portion having a second surface that is substantially perpendicular to the first surface;

a third surface that is recessed and extending between the first and second surfaces;

a fourth surface formed on an opposite side of the third surface and tilted at a predetermined angle with respect to the first surface; and a pair of sidewalls extending from the fourth surface.

19. A clip, comprising:

a first wing portion having a first surface;

a second wing portion having a second surface that is substantially perpendicular to the first surface;

a middle portion formed between the first and second wing portions and having a protruding surface between the first and second surfaces;

a first hook extending from a side of the first wing portion;

a first slot formed between the first hook and the first surface;

a second hook extending from a side of the second wing portion; and a second slot formed between the second hook and the second surface of the second wing portion.

20. A light placement system, comprising:

a mounting strip comprising an illuminating device; and a clip that is attached to a surface of an object and holds the mounting strip to illuminate an area of the object, wherein the surface is an internal surface that is not visible from an external appearance of the object, wherein the clip comprises:

a contact wall comprising a first surface in contact with the surface of the object;

a strip holder that receives and holds the mounting strip; and a spacer extending between the contact wall and the strip holder to position the mounting strip at a predetermined distance from the surface of the object, and wherein the strip holder comprises an inner surface that is at least in partial contact with the mounting strip, the inner surface comprising:

a second surface that is substantially perpendicular to the first surface of the contact wall;

a third surface that is substantially parallel to the first surface of the contact wall; and a fourth surface extending between the second and third surface and shaped to fit a profile of the mounting strip.

21. The light placement system of claim 20, wherein the fourth surface protrudes out from the second and third surfaces.

22. The light placement system of claim 20, wherein the strip holder further comprises:

a first hook extending from a first side of the inner surface; and a second hook extending from a second side of the inner surface, wherein the first and second hooks are flexible.

23. The light placement system of claim 22, wherein the strip holder further comprises:

a first slot formed between the first hook and the first side of the inner surface; and a second slot formed between the second hook and the second side of the inner surface, wherein the first and second slots are tapered to have a narrower bottom end.

24. A light placement system, comprising:

a mounting strip comprising an illuminating device; and a clip that is attached to a surface of an object and holds the mounting strip to illuminate an area of the object, wherein the surface is an internal surface that is not visible from an external appearance of the object, wherein the surface of the object comprises a first and second surface adjoining each other, wherein the clip comprises:

a first wing portion comprising a first inner surface in contact with the mounting strip and a first outer surface in contact with the first surface of the object;

a second wing portion comprising a second inner surface in contact with the mounting strip and a second outer surface in contact with the second surface of the object; and a middle portion extending between the first and second wing portions and having a third inner surface shaped to fit a profile of the mounting strip.

25. The light placement system of claim 24, wherein the first and second wing portions comprise at least one hole extending therethrough.

26. The light placement system of claim 24, wherein the clip further comprises:

a first hook extending from a side of the first wing portion;

a first slot formed between the first hook and the first inner surface of the first wing portion;

a second hook extending from a side of the second portion; and a second slot formed between the second hook and the second inner surface of the second wing portion.

27. The light placement system of claim 26, wherein the first and second slots are tapered to have a narrower bottom end.

28. The light placement system of claim 24, wherein the second inner surface is substantially perpendicular to the first inner surface.

* * * * *